United States Patent [19]

Gessay

[11] Patent Number: 4,662,792

[45] Date of Patent: May 5, 1987

[54] METHOD AND DEVICE FOR THE IN-SITU FORMATION OF COLUMNS OF STABILIZED AND COMPACTED SOIL

[75] Inventor: Jean-Claude Gessay, Roissy-en-Brie, France

[73] Assignee: Sondages Injections Forages "S.I.F." Enterprise Bachy, Levallois-Perret, France

[21] Appl. No.: 729,798

[22] Filed: May 2, 1985

[30] Foreign Application Priority Data

May 7, 1984 [FR] France ..... 84 07047

[51] Int. Cl.[4] ..... E02D 3/12; E02D 5/46

[52] U.S. Cl. ..... 405/233; 405/241; 405/269; 405/271

[58] Field of Search ..... 405/241, 263, 266, 267, 405/269, 271, 233

[56] References Cited

U.S. PATENT DOCUMENTS 3,391,544 7/1968 Daczko .
3,875,751 4/1975 Paus .
4,063,424 12/1977 Takagi et al. .
4,069,678 1/1978 Miura et al. .
4,072,017 2/1978 Shiraki .
4,212,565 7/1980 Watabe ..... 405/269
4,537,536 8/1985 Tsubonuma ..... 405/267

FOREIGN PATENT DOCUMENTS 2109852 5/1972 France .
2010361 6/1979 United Kingdom .

*Primary Examiner*—David H. Corbin
*Attorney, Agent, or Firm*—A. W. Breiner

[57] ABSTRACT

The invention relates to civil engineering works.

In particular, it relates to a device suitable for forming a primary column of stabilized and compacted soil, which comprises at least two parallel shafts driving in opposite directions, two parallel augers with opposite pitch, each auger being provided at the opposite end to the drive shaft with a loosening drillhead and the distance between the axes of the augers being less than the diameter of an auger, the shafts and the shanks of the augers comprising a bore connected to a source of material to be added, and at least one orifice which communicates with the said bore being provided on the shank of each auger so as to discharge the material to be added and allow it to be mixed with the loosened soil.

Applicable in particular for the compaction of railroad territory.

6 Claims, 4 Drawing Figures

METHOD AND DEVICE FOR THE IN-SITU FORMATION OF COLUMNS OF STABILIZED AND COMPACTED SOIL

The invention relates to a method and a device for the in-situ formation of columns of stabilized and compacted soil.

Improving the stability or the bearing capacity of poor quality, loose ground in order to make foundations, embankments, slopes, etc. by the in-situ formation of columns of stabilized soil is a known technique.

The columns of stabilized soil are arranged in groups or combined so as to form walls, spurs, grids, blocks, etc., depending on the desired result, but the basic constituent column is generally in the form of a cylinder of locally occurring soil, the geomechanical properties of which have been improved by incorporating an outside material.

In brief, a primary column is formed by penetrating the ground with a rotary drilling tool. This tool loosens the soil and mixes it with an added material introduced by a wet or dry method via a hollow drive shaft. Once the desired depth has been reached by the tool, the latter is withdrawn.

The added material which is mixed with the locally occurring soil is generally a binder which gives rise to a setting action leading to the formation of a soil concrete, the strength of which depends on the properties of the soil, the quantity and nature of the incorporated binder, and on the degree of homogeneity and compactness of the mixture thus produced.

For a given binder and soil, the two characteristic elements which determine the quality of the result obtained are therefore the homogeneity and the compactness of the mixture.

Although it is possible, using the various methods and devices of the prior art, to obtain more or less the degree of homogeneity sought after, the problem of recompacting the mixture formed in situ is in no way solved.

In order for the binder to be properly distributed throughout the mass of treated soil, the latter needs to be completely reworked by the loosening tool so as to destroy as far as possible the bonds existing between the constituent particles of the soil and so as to be able to achieve thereby thorough mixing between the latter and the incorporated binder. The structure of the final mixture obtained is generally looser than that of virgin soil, the de-structuring of the latter by the loosening tool causing an increase in volume. This decrease in the compactness of the treated soil tends to lessen the strengthening effect resulting from incorporation of the binder.

The object of the invention is to provide a method and a device which, while ensuring a better degree of homogeneity of the soil/binder mixture, make it possible to recompact the latter in situ, thereby improving considerably the mechanical properties of the column of stabilized soil thus formed.

More particularly, the invention relates to a method for the in-situ formation of a primary column of stabilized and compacted soil, which comprises a first phase consisting in penetrating the ground with a rotary drilling tool which loosens the soil and mixes it with a added material, and a second phase consisting in withdrawing the drilling tool from the ground, wherein an ascending movement is imparted to at least some of the loosened soil through the drilling tool during the first phase and wherein a descending movement is imparted to the loosened soil mixed with added material, through the drilling tool during the second phase, which movement tends to compact the said soil.

The invention also relates to a device suitable for implementing the method according to the invention, which comprises at least two parallel shafts driving in opposite directions two parallel augers with opposite pitch, each auger being provided at the opposite end to the drive shaft with a loosening drill-head and the distance between the axes of the augers being less than the diameter of an auger, the shafts and the shanks of the augers comprising a bore connected to a source of material to be added, and at least one orifice which communicates with the said bore being provided on the shank of each auger so as to discharge the added material and allow it to be mixed with the loosened soil.

When the method according to the invention is implemented using the special device described above, the following effects are produced:

During the first drilling and mixing phase, the locally occurring soil, which is loosened by the drilling head, is conveyed in an ascending movement through the device according to the invention, thereby completing the loosening effect due to the head itself and consequently ensuring better dispersion of the added material or binder, introduced by a dry or wet method, throughout the mass of soil. The loosened soil passes through the whole of the device according to the invention as the latter penetrates the ground. In view of the increase in volume caused by loosening, an expansion effect occurs, which is accentuated by the addition of the added material, a more or less large portion of the soil thus made uniform and mixed with the added material being able to emerge at the surface, at the top of the column. If required, this first phase can be repeated once or several times.

During the second compacting phase, once the depth fixed for treatment has been reached, the direction of rotation of the auger elements is reversed, thereby causing a reverse movement of the material as the device according to the invention is withdrawn. Thus, in addition to a complementary homogenizing action, continuous recompaction of the soil/added material mixture is achieved by the device during the entire period of its reascent toward the surface. During this compacting phase, the portion of soil extracted during the drilling phase is reintroduced into the drilled column. As a result of the recompaction effect, it is usually necessary to complete filling of the drilled column by adding extra material.

The method according to the invention can be applied both to firm ground (argillaceous ground, clay, etc.) and to loose ground (sand, gravel, etc.).

The invention will be clearly understood with the aid of the following description which is given with reference to the attached drawings.

Figure 1:
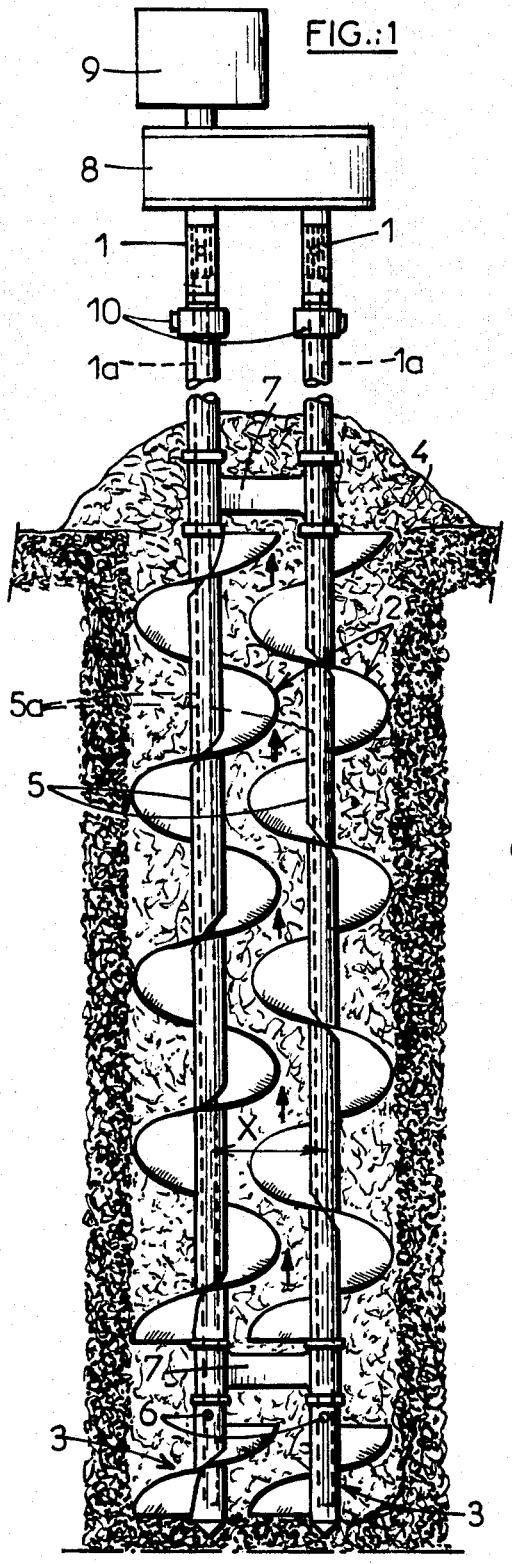
FIG. 1 is a schematic view, in elevation and in cross section, of the soil, showing a device according to the invention and its use during the first phase of the method according to the invention.
Figure 2:
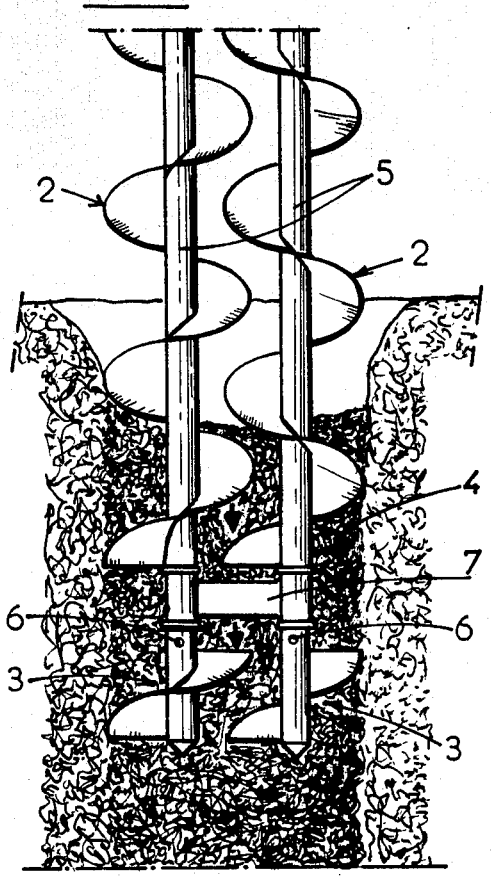
FIG. 2 is a view similar to that shown in FIG. 1, but during the second phase of the invention.

The device shown in FIGS. 1 and 2, which is used to form columns of stabilized and compacted soil according to the method described above, comprises the following elements:

Two parallel shafts 1, which are each provided with a bore 1*a*, drive two helical augers 2 which have opposite pitch and rotate in opposite directions. Each auger is provided at its free end with a loosening drillhead 3 which has been adapted to the type of ground. This may be, for example, as shown, a head in the form of a helix, or else a knife. The distance X between the axes of the augers is less than the diameter of the latter so that the turns of the two augers are effectively engaged with each other so as to ensure a forced movement or flow of the loosened soil 4 by means of the two augers. The shank 5 of each auger also has a bore 5*a* which communicates with the bore of the corresponding drive shaft, thereby making it possible to convey the material to be added or binder, by a dry or wet method, down to the orifices 6 provided on the shank of each auger so as to ensure that it is thoroughly mixed with the loosened soil.

The length of the augers is chosen in accordance with the depth of the column to be formed. It is generally between $\frac{1}{4}$ and $\frac{1}{2}$ the length of the column, but in certain cases it could be increased so as to be of the same length.

It must be noted that the augers, instead of having a continuous helical profile, could be discontinuous, that is to say be replaced by a plurality of helices located at intervals.

In accordance with the depth of the column to be formed, a certain number of double bearings 7 are located at intervals along the drive shafts and the augers so as to keep them parallel.

These bearings could be replaced along the drive shafts by a continous hollow beam which could, if necessary, be used to convey the material to be added or binder to the end of the augers.

The two drive shafts 1 are mounted on a geared reducing/reversing device 8, itself connected to a motor 9 which drives them as well as the augers in rotation, in opposite directions and at the same speed. This geared-motor assembly 8, 9 may be carried by a drilling machine (not shown) installed at the surface in line with the column to be formed, either by means of a slide on which it is able to move longitudinally either freely or by means of a translational device. As a variation, it may be suspended from the jib of a hoist (a crane or similar device).

Figure 3:
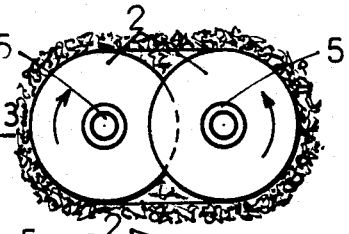
FIGS. 3 and 4 are schematic views showing the direction of rotation of the auger elements of the device according to the invention during the first and second phases, respectively, of the method according to the invention.

The operation of forming a compacted column of stabilized soil may be described as follows:

With the carrying appliance installed in line with the chosen position, the shafts and augers are made to rotate in the direction corresponding to screwing of the augers into the ground (FIGS. 1 and 3). The speed of penetration is controlled so as to optimize the soil-loosening effect. The material to be added or binder may be introduced at any time during the drilling operation. In the case of the wet method, it is pumped by a pump located at the surface through the revolving heads 10 mounted on the end of the drive shafts. In the case of the dry method, it is forced by means of compressed air through the same heads.

Figure 4:
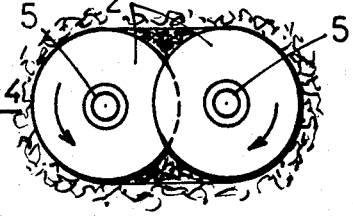

Once the desired depth has been reached, the direction of rotation of the shafts and augers is reversed and the device according to the invention is brought back up in a continuous manner (FIGS. 2 and 4). The direct mechanical effect of the augers tends to make the device move back up by itself. By controlling this upward movement and exerting a controlled pressure on the device, it is possible to obtain recompaction of the soil-/added material mixture. Injection of the material to be added may be continued, if required, during all or part of this recompaction phase. The soil which is brought to the surface during the drilling phase is conveyed back down into the column. The addition of extra material is usually required in order to fill the hole.

It should be noted that, as the bores of the augers are independent ducts, it is possible, if desired, to feed one of said bores with a material to be added which is different from that feeding the other bore, so as these materials react in situ together or with the soil.

As a result of the invention, it is possible to obtain columns of stabilized and compacted soil, the mechanical properties of which are far superior to those of columns obtained in accordance with the prior art, without recompaction.

A particularly interesting application of the method and the device according to the invention is the stabilization of railroad territory.

It is obvious that the embodiment described is merely an example and that it could be modified, in particular by the substitution of equivalent technical features, without necessarily departing from the scope of the invention.

I claim:

1. A method for the in-situ formation of a primary column of stabilized and compacted soil, comprising a first phase in which the ground is penetrated with a rotary drilling tool which loosens the soil and mixes it with an added material, and during which an ascending movement is imparted to at least some of the loosened soil through the drilling tool, and a second phase in which the drilling toll is withdrawn from the ground, wherein a descending movement is imparted to the loosened soil mixed with added material, through the drilling tool, by exerting a controlled pressure on the drilling tool during the said second phase, which descending movement tends to compact the said soil.

2. A method as claimed in claim 1, wherein the drilling and mixing operations of the first phase are repeated at least once.

3. A device for the formation of a primary column comprising at least two parallel shafts driving in rotation two parallel augers, each auger being provided at the opposite end to the drive shaft with a loosening drill-head, the distance between the axes of the augers being less than the diameter of an auger, the shafts and the shanks of the augers comprising a bore connected to a source of material to be added, and at least one orifice which communicates with the said bore being provided on the shank of each auger so as to discharge the material to be added allowing the added material to be mixed with the loosened soil, said augers having opposite pitches and being driven in rotation in opposite directions, said device including means for reversing the direction of rotation of the augers.

4. A device as claimed in claim 3, wherein the drilling head is in the form of a helix.

5. A device as claimed in claim 3, wherein the shafts and augers are kept parallel by means of double bearings.

6. A device according to claim 3, wherein the bore of one of said augers is connected to a source of a material to be added different from the material to be added of the source connected to the bore of the other auger.

* * * * *